US006834569B2

(12) United States Patent
Wang

(10) Patent No.: US 6,834,569 B2
(45) Date of Patent: Dec. 28, 2004

(54) CRESCENT WRENCH

(76) Inventor: Ching-Shu Wang, No. 8-5, Lane 433, Ta-Li Rd., Ta-Li City, Tai-Chung Hsien (TW)

( * ) Notice: Subject to any disclaimer, the term of this patent is extended or adjusted under 35 U.S.C. 154(b) by 0 days.

(21) Appl. No.: 10/216,754

(22) Filed: Aug. 12, 2002

(65) Prior Publication Data

US 2004/0025647 A1 Feb. 12, 2004

(51) Int. Cl.[7] ..... B25B 13/14

(52) U.S. Cl. ..... 81/133; 81/127; 81/176.1; 81/167

(58) Field of Search ..... 81/133, 129, 129.5, 81/126, 127, 166, 167, 176.1, DIG. 8

(56) References Cited

U.S. PATENT DOCUMENTS

| | | | | | |
|---|---|---|---|---|---|
| 207,709 | A | * | 9/1878 | Brett | 81/127 |
| 1,023,001 | A | * | 4/1912 | Bennetch | 81/133 |
| 1,181,654 | A | * | 5/1916 | Eifel | 81/319 |
| 1,430,694 | A | * | 10/1922 | Short | 81/133 |
| 2,600,617 | A | * | 6/1952 | Coates | 81/165 |
| 2,672,779 | A | * | 3/1954 | Gross | 81/151 |
| 2,707,413 | A | * | 5/1955 | Goodnow | 81/127 |
| 2,708,386 | A | * | 5/1955 | Ellis, Jr. et al. | 81/165 |
| 3,171,307 | A | * | 3/1965 | Jamal | 81/129.5 |
| 3,326,068 | A | * | 6/1967 | Lanzetta | 81/165 |
| 4,561,330 | A | * | 12/1985 | Chen | 81/129.5 |
| 4,802,389 | A | * | 2/1989 | Shultz | 81/127 |
| 4,942,790 | A | * | 7/1990 | Wang | 81/133 |
| 5,095,782 | A | * | 3/1992 | Galea | 81/127 |
| 6,167,786 | B1 | * | 1/2001 | Kilgore | 81/142 |
| 6,481,317 | B1 | * | 11/2002 | Reyes | 81/133 |

FOREIGN PATENT DOCUMENTS

| | | | | |
|---|---|---|---|---|
| CH | 652067 | A5 | * 10/1985 | B25B/13/14 |

* cited by examiner

*Primary Examiner*—David B. Thomas
(74) *Attorney, Agent, or Firm*—Charles E. Baxley

(57) ABSTRACT

A crescent wrench is constructed to include a fixed jaw, a transmission gear wheel pivoted to the fixed jaw, a movable jaw meshed with the transmission gear wheel, a sliding track structure adapted to guide movement of the movable jaw horizontally relative to the fixed jaw, and a handle detachably coupled to the transmission gear wheel and adapted for turning the transmission gear wheel to move the movable jaw horizontally relative to the fixed jaw.

2 Claims, 5 Drawing Sheets

CRESCENT WRENCH

BACKGROUND OF THE INVENTION

1. Field of the Invention

The present invention relates to wrenches and, more particularly, to crescent wrench.

2. Description of the Related Art

Screw bolts and nuts are commonly used to fix parts of machines and furniture. For grasping and turning different sizes of screw bolts or nuts, different sizes of wrenches shall be used. A crescent wrench is an adjustable wrench suitable for grasping and turning different sizes of screw bolts and nuts. FIG. 1 shows a regular commercially available crescent wrench. This structure of crescent wrench comprises a handle 1, a fixed jaw 2 formed integral with one end, namely, the front end of the handle 1, a movable jaw 3 coupled to the front end of the handle 1, and a thumbscrew 5 mounted in an opening 4 in the handle 1 for turning with the thumb to move the movable jaw 3 relative to the fixed jaw 2. By means of rotating the thumbscrew 5 to move the movable jaw 3 relative to the fixed jaw 2, the pitch between the fixed jaw 2 and the movable jaw 3 is adjusted subject to the workpiece to be grasped or turned. This structure of crescent wrench is still not satisfactory in function. When rotating the workpiece, excessive reactive force from the workpiece may cause the thumbscrew 5 to slip.

SUMMARY OF THE INVENTION

The present invention has been accomplished to provide a crescent wrench, which eliminates the aforesaid problem. It is the main object of the present invention to provide a crescent wrench, which is automatically adjustable subject to the size of the workpiece to be grasped or turned. It is another object of the present invention to provide a crescent wrench, which can easily be operated to grasp or release the workpiece. It is still another object of the present invention to provide a crescent wrench, which positively transfers applied rotary driving force to the workpiece, causing the workpiece to be positively synchronously rotated with the crescent wrench. It is still another object of the present invention to provide a crescent wrench, which can be arranged into a compacted condition to reduce storage space when not in use.

To achieve these and other objects of the present invention, the crescent wrench comprises a fixed jaw, a transmission gear wheel pivoted to the fixed jaw, a movable jaw coupled to the fixed jaw and meshed with the transmission gear wheel, a sliding track structure formed in the fixed jaw and the movable jaw and adapted to guide movement of the movable jaw horizontally relative to the fixed jaw, and a handle adapted for turning the transmission gear wheel to move the movable jaw horizontally relative to the fixed jaw.

DETAILED DESCRIPTION OF THE PREFERRED EMBODIMENT

Figure 1:
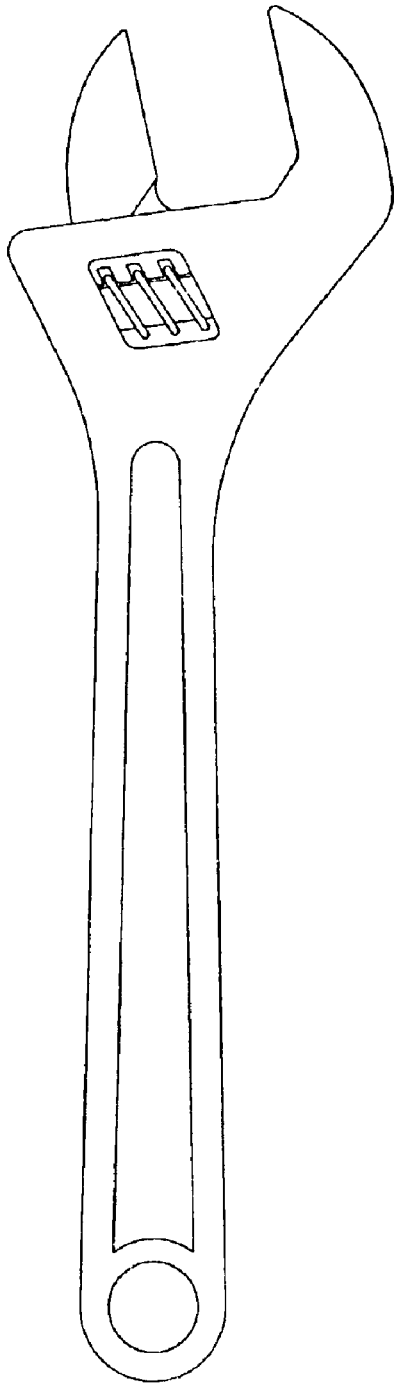
Fig. 1 PRIOR ART
FIG. 1 is a plain view of a crescent wrench according to the prior art.
Figure 2:
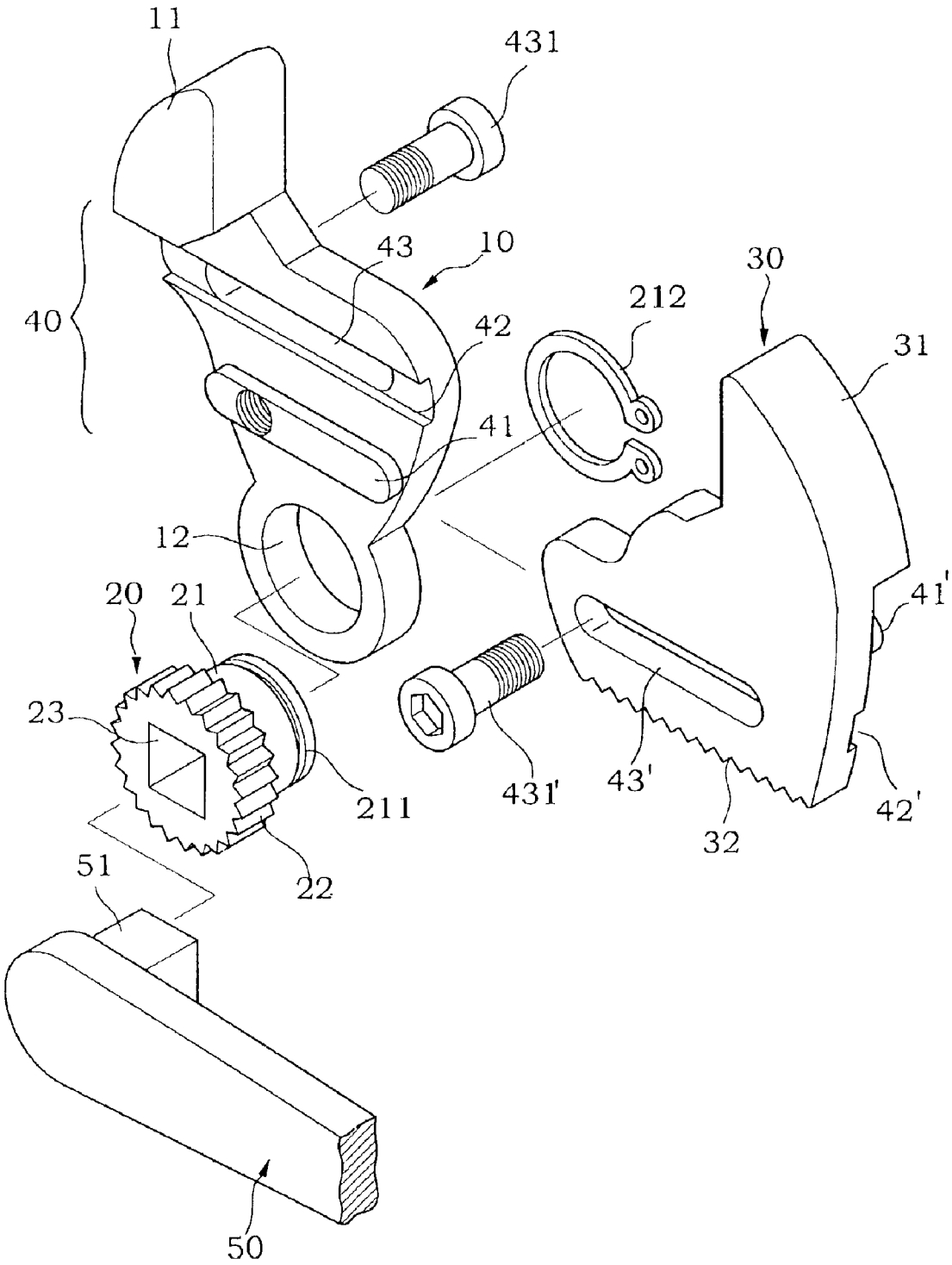
FIG. 2 is an exploded view of a crescent wrench according to the present invention.
Figure 3:
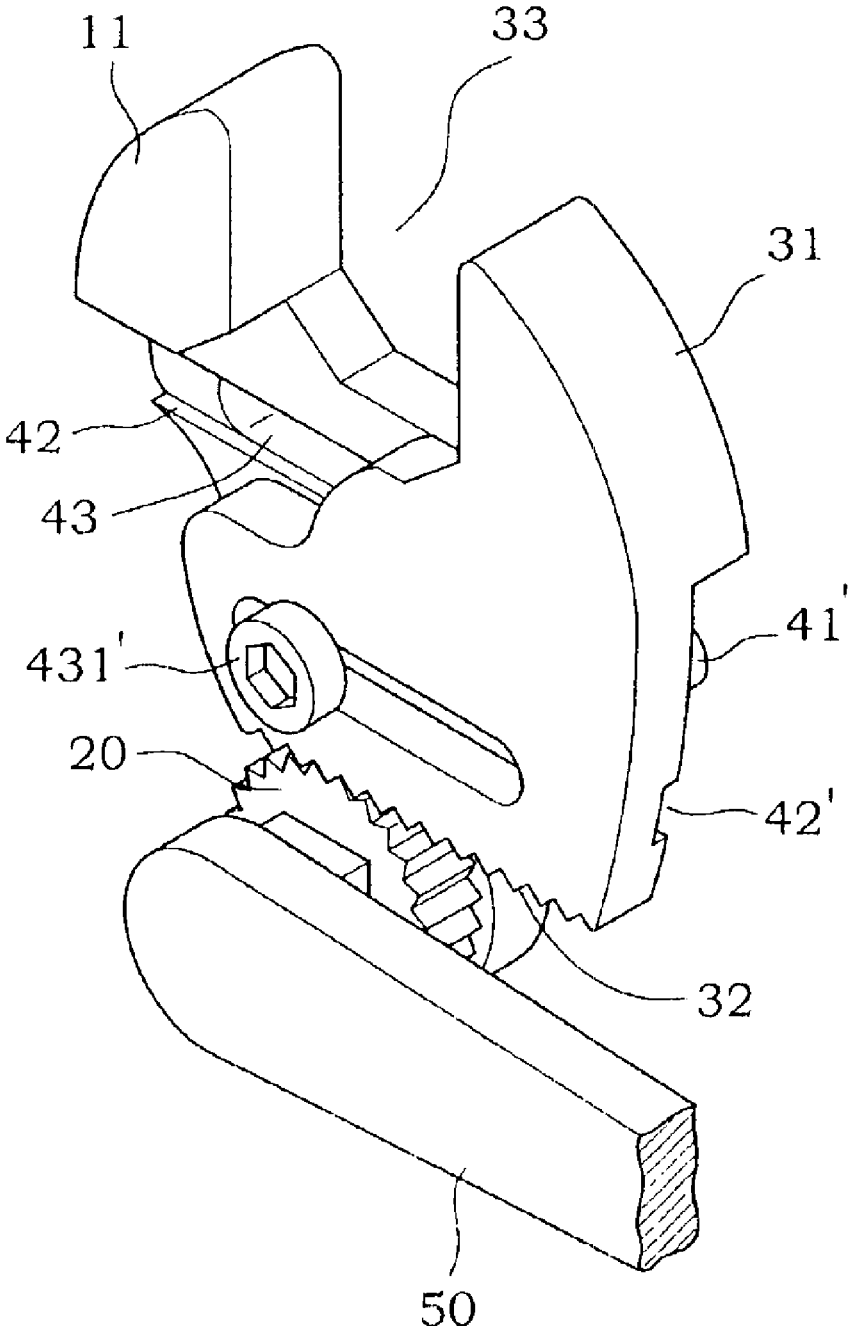
FIG. 3 is an elevational assembly view of the crescent wrench according to the present invention.

Referring to FIGS. 2 and 3, a crescent wrench in accordance with the present invention is shown comprised of a fixed jaw 10, a transmission gear wheel 20, a movable jaw 30, a sliding track structure 40, and a handle 50.

The fixed jaw 10 has a nose 11 at the front side and an axle hole 12 at the rear side.

The transmission gear wheel 20 has a serrated periphery 22, a non-circular center coupling hole 23, a fixed gear wheel axle 21 perpendicularly extended from one side thereof at the center, and an annular locating groove 211 extended around the periphery of the fixed gear wheel axle 21. The fixed gear wheel axle 21 of the transmission gear wheel 20 is inserted through the axle hole 12 of the fixed jaw 10, and then a C-shaped clamp 212 is fastened to the annular locating grove 211 to secure the transmission gear wheel 20 to the fixed jaw 10, enabling the transmission gear wheel 20 to be rotated in the axle hole 12.

The movable jaw 30 has a nose 31 at the front side, and a transverse rack 32 at the rear side for engaging the serrated periphery 22 of the transmission gear wheel 20. The nose 11 of the fixed jaw 10 and the nose 31 of the movable jaw 30 define a clamping space 33 adapted to hold down the workpiece 60 (see also FIG. 4).

The sliding track structure 40 comprises a first transverse sliding rail 41 fixedly provided at one side of the fixed jaw 10 and spaced between the nose 11 and the axle hole 12, a first transverse sliding groove 42 formed in the fixed jaw 10 and spaced between the first sliding rail 41 and the nose 11, a first elongated slot 43 extended through the fixed jaw 10 along the length of the first transverse sliding groove 42, a second transverse sliding rail 41' fixedly provided at one side of the movable jaw 30 and coupled to the first transverse sliding groove 42 in the fixed jaw 10, a second transverse sliding groove 42' formed in the movable jaw 30 and coupled to the first sliding rail 41 at the fixed jaw 10, and a second elongated slot 43' extended through the movable jaw 30 along the length of the second transverse sliding groove 42', a first screw bolt 431 inserted through the first elongated slot 43 and fastened to the second sliding rail 41' to guide movement of the movable jaw 30 relative to the fixed jaw 10, and a second screw bolt 431' inserted through the second elongated slot 43' and fastened to the first sliding rail 41 to guide movement of the movable jaw 30 relative to the fixed jaw 10.

The handle 50 has a front coupling rod 51 fitted into the non-circular center coupling hole 23 of the transmission gear wheel 20. Rotating the handle 50 causes the transmission gear wheel 20 to move the movable jaw 30 relative to the fixed jaw 11.

Figure 4:
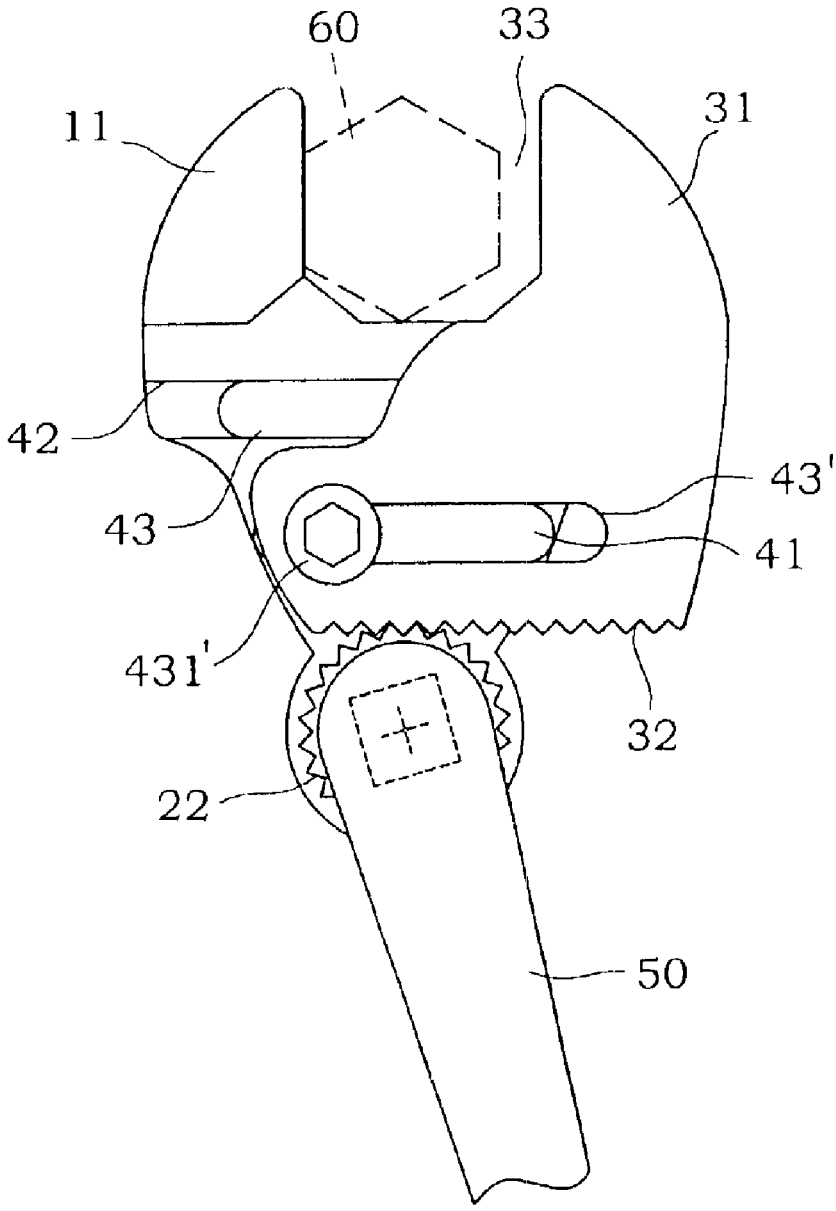
FIG. 4 is an applied view of the crescent wrench according to the present invention (I).
Figure 5:
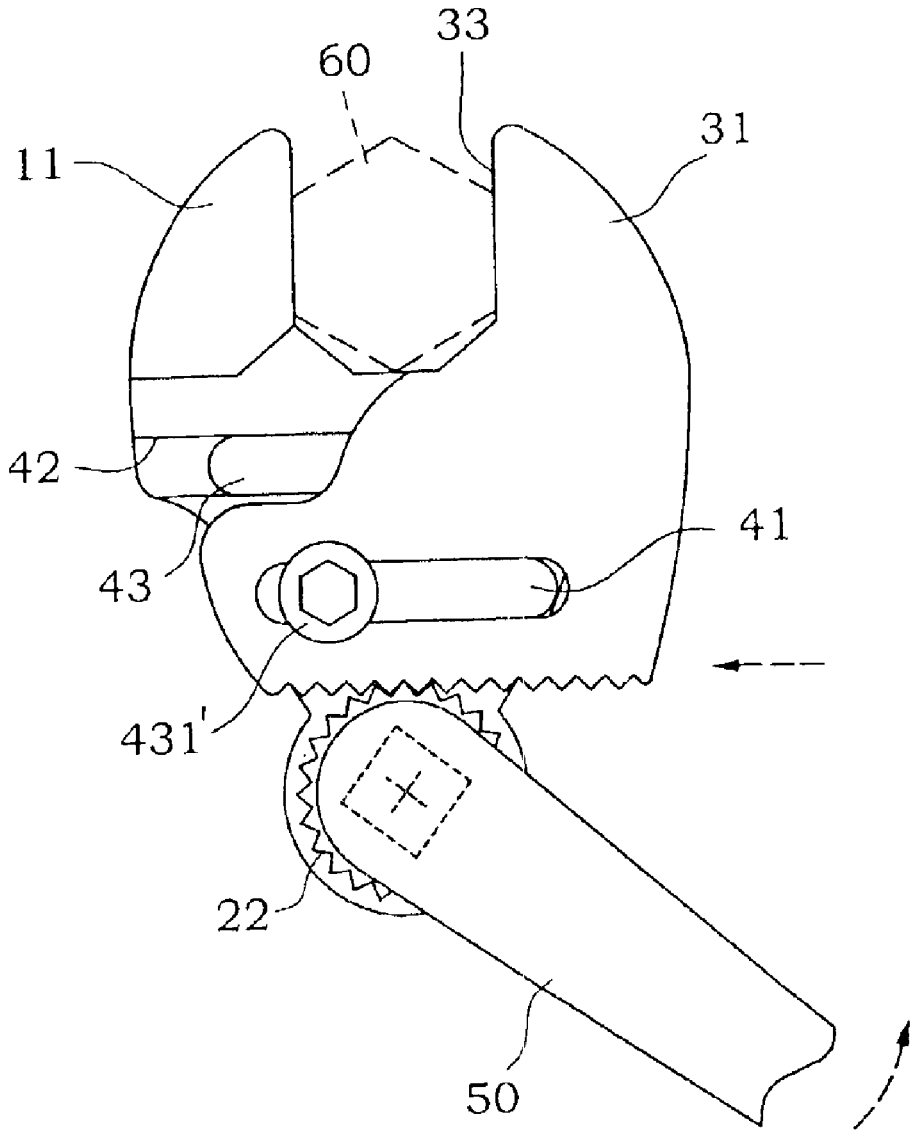
FIG. 5 is an applied view of the crescent wrench according to the present invention (II).

Referring to FIGS. 4 and 5, when in use, the crescent wrench is attached to the workpiece 60, keeping the workpiece 60 received in the clamping space 33, and then turn the handle 50 to rotate the transmission gear wheel 20 counter-clockwise, thereby causing the transmission gear wheel 20 to move the movable jaw 30 horizontally toward the fixed jaw 10 and to narrow the clamping space 33, and therefore the workpiece 60 is rotated with the crescent wrench when continuously turning the handle 50 in the counter-clockwise direction. On the contrary, when turning the handle 50 to rotate the transmission gear wheel 20 clockwise, the movable jaw 30 is horizontally moved apart from the fixed jaw to broad the clamping space 33 and to release the workpiece 60.

When the user turning the handle 50, the transmission gear wheel 20 transfers the rotary force from the handle 50 to the movable jaw 30, to further force the movable jaw 30 and the fixed jaw 10 to grasp the workpiece 60. When the applied force increased, the produced clamping force is relatively increased. Therefore, the crescent wrench can positively grasp and turn the workpiece 60, preventing slipping of the jaws 10 and 30 from the workpiece 60. When turning the handle 50 in the reversed direction, the movable jaw 30 is automatically moved away from the workpiece 60. Further, when not in use, the handle 50 can be separated from the transmission gear wheel 20 for carrying or storage separately.

As indicated above, the invention provides advantages as follows:

1. When the user turning the handle 50, the transmission gear wheel 20 is forced to move the movable jaw 30 toward the fixed jaw 10, thereby causing the noses 11 and 31 to grasp the workpiece 60 positively.
2. When the user turning the handle 50 in the reversed direction, the movable jaw 30 is automatically moved apart from the fixed jaw 10 to release the workpiece 60.
3. The transmission gear wheel 20 transfers applied force from the user to the movable jaw 30, causing the movable jaw 30 to hold down the workpiece with the fixed jaw 10 positively.
4. The user can detach the handle 50 from the crescent wrench to reduce storage space of the crescent wrench when not in use.
5. A relatively longer handle may be used and fastened to the transmission gear wheel 20 to prolong the arm of force of the crescent wrench.

A prototype of crescent wrench has been constructed with the features of FIGS. 2~5. The crescent wrench functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A crescent wrench comprising:

a fixed jaw;

a transmission gear wheel pivoted to said fixed jaw;

a movable jaw coupled to said fixed jaw and meshed with said transmission gear wheel;

a sliding track structure formed in said fixed jaw and said movable jaw and adapted to guide movement of said movable jaw horizontally relative to said fixed jaw; and a handle adapted for turning said transmission gear wheel to move said movable jaw horizontally relative to said fixed jaw wherein said sliding track structure comprises a first transverse sliding rail and a first transverse sliding groove respectively formed in one side of said fixed jaw, a second transverse sliding rail and a second transverse sliding groove respectively formed in one side of said movable jaw and respectively coupled to said first transverse sliding groove and said first transverse sliding rail and wherein said sliding tract structure further comprises a first elongated slot extended through said fixed jaw along the length of said first transverse sliding groove, and a first screw bolt inserted through said first elongated slot and fixedly fastened to said second transverse sliding rail to guide movement of said movable jaw along said first transverse sliding groove relative to said fixed jaw.

2. The crescent wrench as claimed in claim 1, wherein said sliding track structure further comprises a second elongated slot extended through said fixed jaw along the length of said second transverse sliding groove, and a second screw bolt inserted through said second elongated slot and fixedly fastened to said first transverse sliding rail to guide movement of said movable jaw along said first transverse sliding groove relative to said fixed jaw.

* * * * *